US006651772B1

(12) United States Patent
Esser

(10) Patent No.: US 6,651,772 B1
(45) Date of Patent: Nov. 25, 2003

(54) LOUDSPEAKER CONE PROTECTOR

(75) Inventor: Timo Esser, Brentwood (GB)

(73) Assignee: Visteon Global Technologies, Inc., Dearborn, MI (US)

( * ) Notice: Subject to any disclaimer, the term of this patent is extended or adjusted under 35 U.S.C. 154(b) by 35 days.

(21) Appl. No.: 10/056,677

(22) Filed: Oct. 25, 2001

(30) Foreign Application Priority Data

Oct. 27, 2000 (GB) ..... 0026265

(51) Int. Cl.[7] ..... G10K 13/00
(52) U.S. Cl. ..... 181/171; 181/172
(58) Field of Search ..... 181/171, 157, 181/167, 172, 148, 153

(56) References Cited

U.S. PATENT DOCUMENTS 4,281,224 A * 7/1981 Castagna ..... 381/391
4,919,227 A 4/1990 Chicoine
4,974,698 A * 12/1990 Smith ..... 181/150
5,099,949 A * 3/1992 Mitobe ..... 181/171
D473,213 S * 4/2003 Abdo ..... D14/219

FOREIGN PATENT DOCUMENTS

DE 44 34 719 A1 6/1995
GB 2 305 064 3/1997

* cited by examiner

*Primary Examiner*—Kimberly Lockett
(74) *Attorney, Agent, or Firm*—Brinks Hofer Gilson & Lione

(57) ABSTRACT

The present invention relates to a protector for a loudspeaker cone. The loudspeaker protector (25) comprises: a sheet of flexible material (26), the sheet being bounded by an edge (28); one or more mounting points (36) on the sheet (26), each mounting point (36) being adapted to receive a fixing member (38) through the sheet (26) and being positioned in a peripheral region (56) of the sheet (26); and one or more lines of weakness (50) in the sheet, the sheet (26) being thereby adapted to tear or break preferentially along the lines of weakness (50); in which the lines of weakness (50) separate the peripheral region (56) at each mounting point (36) from a central area (52) of the sheet (26), so that the central area (52) of the sheet may be torn from the peripheral regions (56) after the mounting points (36) have been held down by said fixing members (38).

14 Claims, 4 Drawing Sheets

LOUDSPEAKER CONE PROTECTOR

BACKGROUND

1. Field of the Invention

The present invention relates to a protector for a loudspeaker cone.

2. Related Art

Loudspeaker cones are relatively fragile and easily damaged. A paper loudspeaker cone can be torn, punctured or creased by a single contact with a person's fingers or other object. Once a loudspeaker has been installed in a cabinet or other enclosure, it will be protected by its surrounds, including a mesh or grille through which sound is emitted by the loudspeaker.

In order to prevent accidental damage to loudspeakers between the point of manufacture and installation in an enclosure, it is known to provide a rigid moulded plastic grille that is permanently affixed to a frame surrounding the cone. This is an effective form of protection. Such rigid grilles have also been used to electrically insulate a metal loudspeaker frame from metal mounting screws passingthrough the frame. Disadvantages of such a rigid protective grille are that this is relatively expensive to manufacture, even in high volume, and the grille itself inevitably reflects and absorbs some of the sound emitted by the loudspeaker.

SUMMARY OF THE INVENTION

It is an object of the present invention to address the problems cited above, and provide a protector for a loudspeaker cone when addresses these issues.

Accordingly, the invention provides a loudspeaker protector, comprising: a sheet of flexible material, the sheet being bounded by an edge; one or more mounting points on the sheet, each mounting point being adapted to receive a fixing member through the sheet and being positioned in a peripheral region of the sheet; and one or more lines of weakness in the sheet, the sheet being thereby adapted to tear or break preferentially along the lines of weakness; in which the lines of weakness separate the peripheral region at each mounting point from a central area of the sheet, so that the central area of the sheet may be torn from the peripheral region(s) after the or each mounting point has been held down by said fixing member(s).

Also according to the invention, there is provided a loudspeaker, comprising a frame, one or more mounting features by which the loudspeaker may be secured to an external object, a loudspeaker cone, and a loudspeaker protector, in which the cone is supported peripherally by the frame, the mounting features are provided on the frame beyond the periphery of the cone, the loudspeaker protector is affixed to the frame to protect the cone supported within the frame, and the loudspeaker protector has one or more mounting points in alignment with the mounting features of the frame, wherein the loudspeaker protector comprises: a sheet of flexible material, the sheet being bounded by an edge; one or more mounting points on the sheet, each mounting point being adapted to receive a fixing member through the sheet and being positioned in a peripheral region of the sheet; one or more lines weakness in the sheet, the sheet being whereby adapted to tear or break preferentially along the lines of weakness; in which the lines of weakness separate the peripheral region at each mounting point from a central area of the sheet, so that the central area of the sheet may be torn from the peripheral region(s) after the or each mounting point has been held down by said fixing member (s).

The mounting point in the loudspeaker protector is preferably an aperture, slit, dimple or other such feature formed or cut in the sheet material. If the mounting point is a hole through the sheet, then the sheet may include a sleeve that extends transversely away from the sheet around said hole.

Often, the loudspeaker frame will be a metallic frame. The mounting features of the frame can then be formed in the metal of the frame. The mounting points of the loudspeaker protector may then serve to insulate electrically the frame from the fixing members. In a preferred embodiment of the invention, each of the mounting features is an aperture in the frame, and the loudspeaker protector has a sleeve that extends into the aperture to insulate electrically the frame from the fixing member, which may be a metallic screw, bolt, press-fit stud or rivet.

The invention also provides a method of installing a loudspeaker in an enclosure using at least one fixing member, when the loudspeaker is according to the invention, wherein the method comprises the steps of:

a) placing the loudspeaker in the enclosure;

b) using the fixing member(s) to secure the loudspeaker within the enclosure; and then c) pulling the loudspeaker protector from the loudspeaker to tear the loudspeaker protector along the lines of weakness in order to remove the central portion of the loudspeaker protector from the loudspeaker, while leaving the loudspeaker protector mounting points held to the loudspeaker at the fixing member(s).

BRIEF DESCRIPTION OF THE DRAWINGS

The invention will now be described by way of example, with reference to the accompanying drawings, in which.

DETAILED DESCRIPTION

Figure 1:
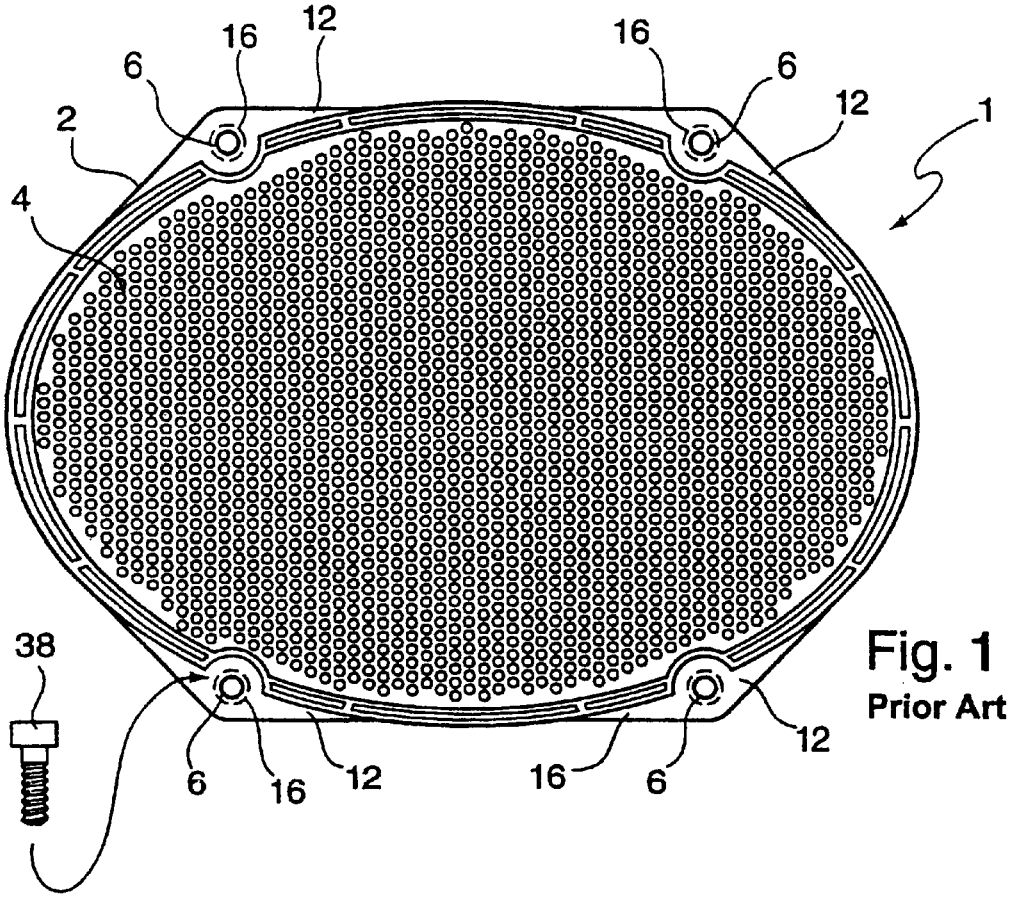
Fig. 1 Prior Art
FIG. 1 is a plan view of a prior art loudspeaker protector.

FIG. 1 shows a prior art loudspeaker protector 1, formed in a rigid moulded plastic material with a continuous oval rim 2 inside of which are a large number of perforations 4. The perforations 4 are circular and closely packed so that these form a grille through which sound emitted by a loudspeaker may pass.

With reference now also to FIGS. 3 to 6 the loudspeaker protector 1 in use is permanently affixed to a conventional loudspeaker 30 by applying glue (not shown) between the rim 2 of the loudspeaker protector 1 and a similarly shaped rim 39 of a pressed steel loudspeaker frame 40. Most of this glue is applied between matching flanges 12,14 of the loudspeaker protector 1 and loudspeaker frame 40, in areas surrounding four matching holes 6,8 in each of the rim 2 of the loudspeaker protector 1 and rim 39 of the loudspeaker frame 40. The holes 6,8 align so that a mounting screw or bolt 38 can be passed through each of the aligned pairs of holes 6,8 and into corresponding threaded bores 47 in an enclosure 75, such as a recess in a metallic motor vehicle door 80, to mount and secure the loudspeaker 30 to the enclosure 75.

The loudspeaker protector 1 serves another purpose in this automotive application, by providing electrical insulation between the loudspeaker frame 30 and the four metal screws or bolts 38 used to secure the loudspeaker 30 to the metallic enclosure 75. This insulation is ensured by a cylindrical sleeve 16 that inserts fully into the loudspeaker frame clearance holes 8 when the loudspeaker protector 1 is affixed to the loudspeaker 30. This electrical insulation is important because it prevents electrical current from flowing from the metallic loudspeaker frame 40 to the metallic chassis of the circle through the connecting screw on at 38, in the event that an electrical fault develops within the loudspeaker 30. Because of this need for, electrical insulation, the loudspeaker protector 1 must be permanently affixed to the loudspeaker frame 40. This does provide the benefit that physical protection is always provided to delicate components of the loudspeaker, in particular a loudspeaker cone 20, a inner loudspeaker cone 22, and a flexible surround 24 around the cone 20. Usually, the loudspeaker cone 20 and inner loudspeaker cone 24 will be made from paper. However, the grille 4 does impair somewhat the sound quality of the speaker 30. In order to minimize this impairment, the loudspeaker protector 1 is moulded from a relatively expensive plastic material sold under the trade mark Noryl, which is a PPE-PS blend. This has high strength, and is suitable for use with adhesives that can affix this permanently to the metal loudspeaker frame 40.

Even in high volume production, the cost of the prior art loudspeaker protector 1 is about US$ 0.20 to US$ 0.25. This is a significant additional cost to the manufacturing cost of the loudspeaker 30.

Figure 2:
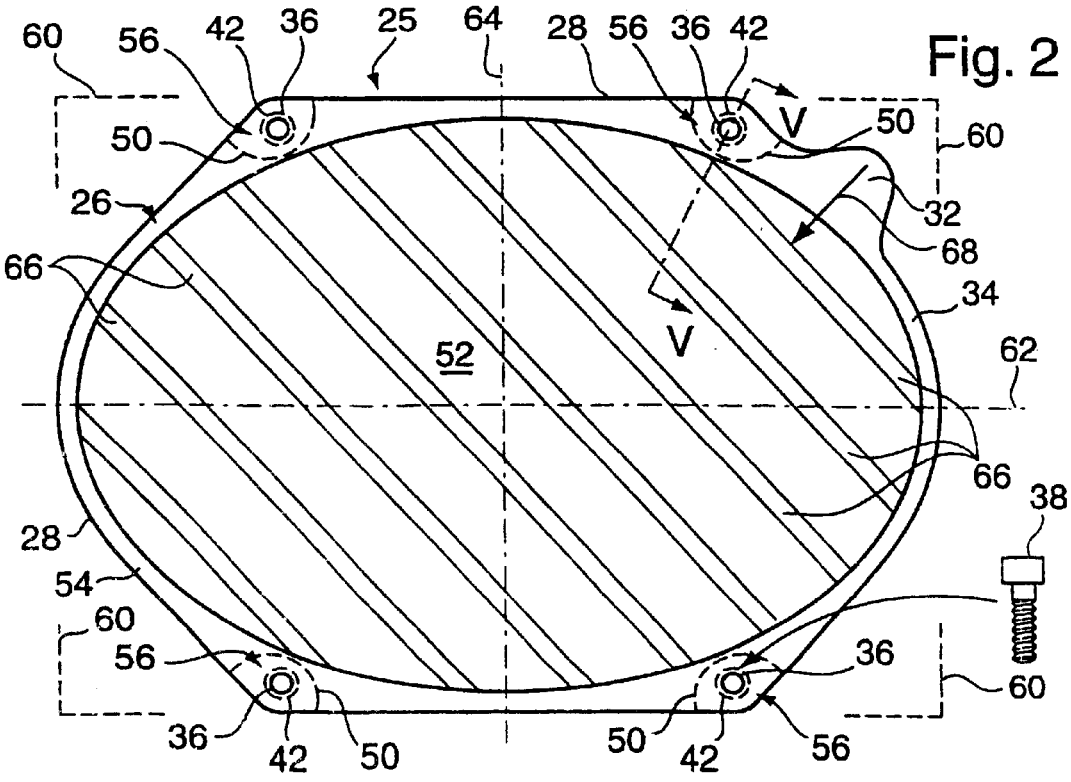
FIG. 2 is a plan view of a loudspeaker protector affixed to a loudspeaker, according to the invention.
Figure 3:
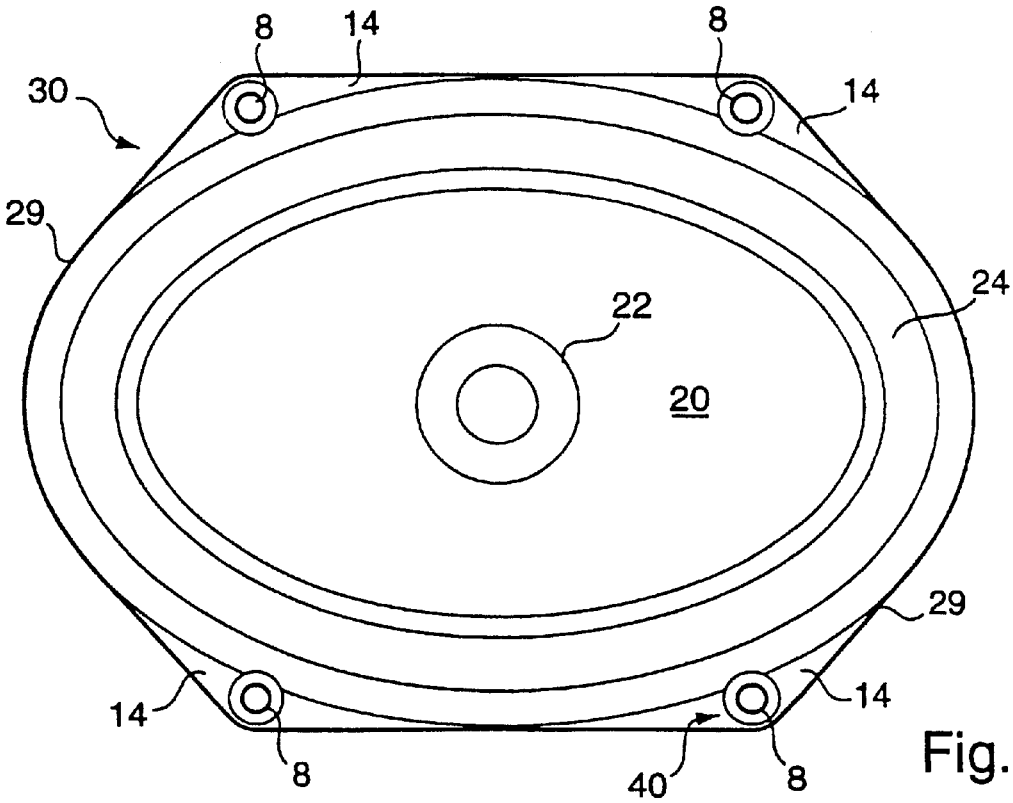
FIG. 3 is a plan view of the loudspeaker of FIG. 2, with the loudspeaker protector removed, showing a loudspeaker cone supported by a metallic loudspeaker frame.
Figure 4:
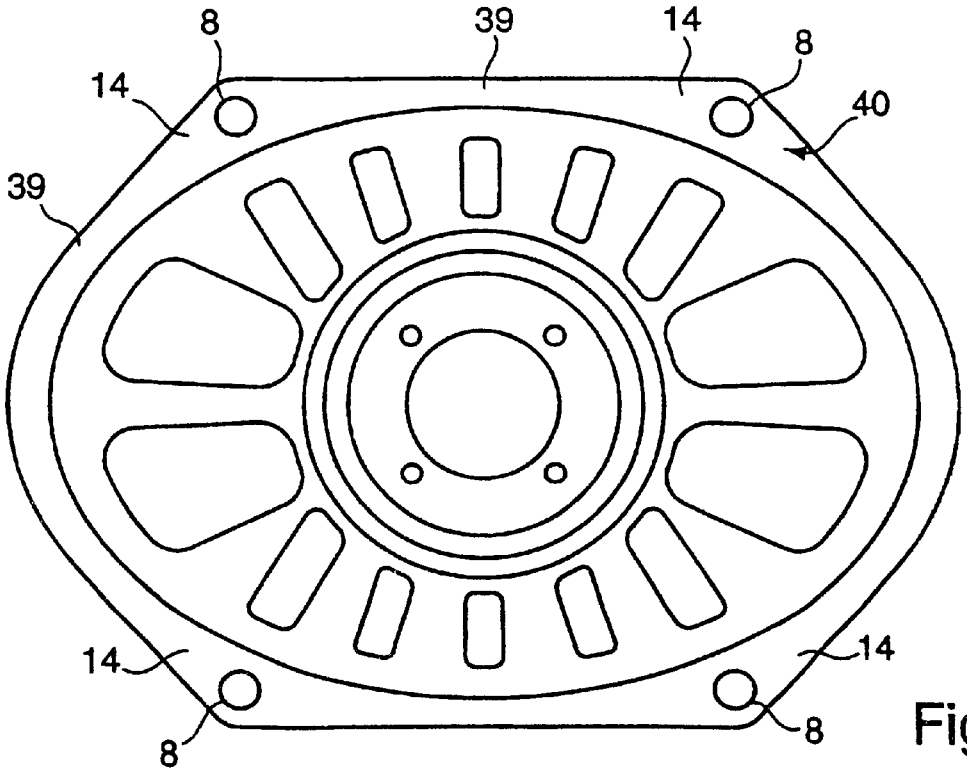
FIG. 4 is a plan view of the loudspeaker frame of FIG. 4.

FIG. 2 shows a loudspeaker protector 25 according to the invention, when affixed to the loudspeaker 30 of FIG. 3. The loudspeaker protector 25 comprises a sheet of flexible material 26, which is preferably 250 $\mu$m thick film, for example polyester film (PET) or polyether sulphone (PES), which has been cut and moulded into shape. The loudspeaker protector 25 has an edge 28 that generally conforms to the peripheral outline 29 of the loudspeaker 30, with the exception of a tab 32 that extends outwards from a rim area 34 of the protector 25.

The loudspeaker protector 25 has four mounting points in the form of clearance holes 36 in the rim 34. When the protector 25 is affixed to the loudspeaker 30, these four clearance holes 36 align with the four holes 8 in the metallic frame 40 of the loudspeaker 30.

Figure 5:
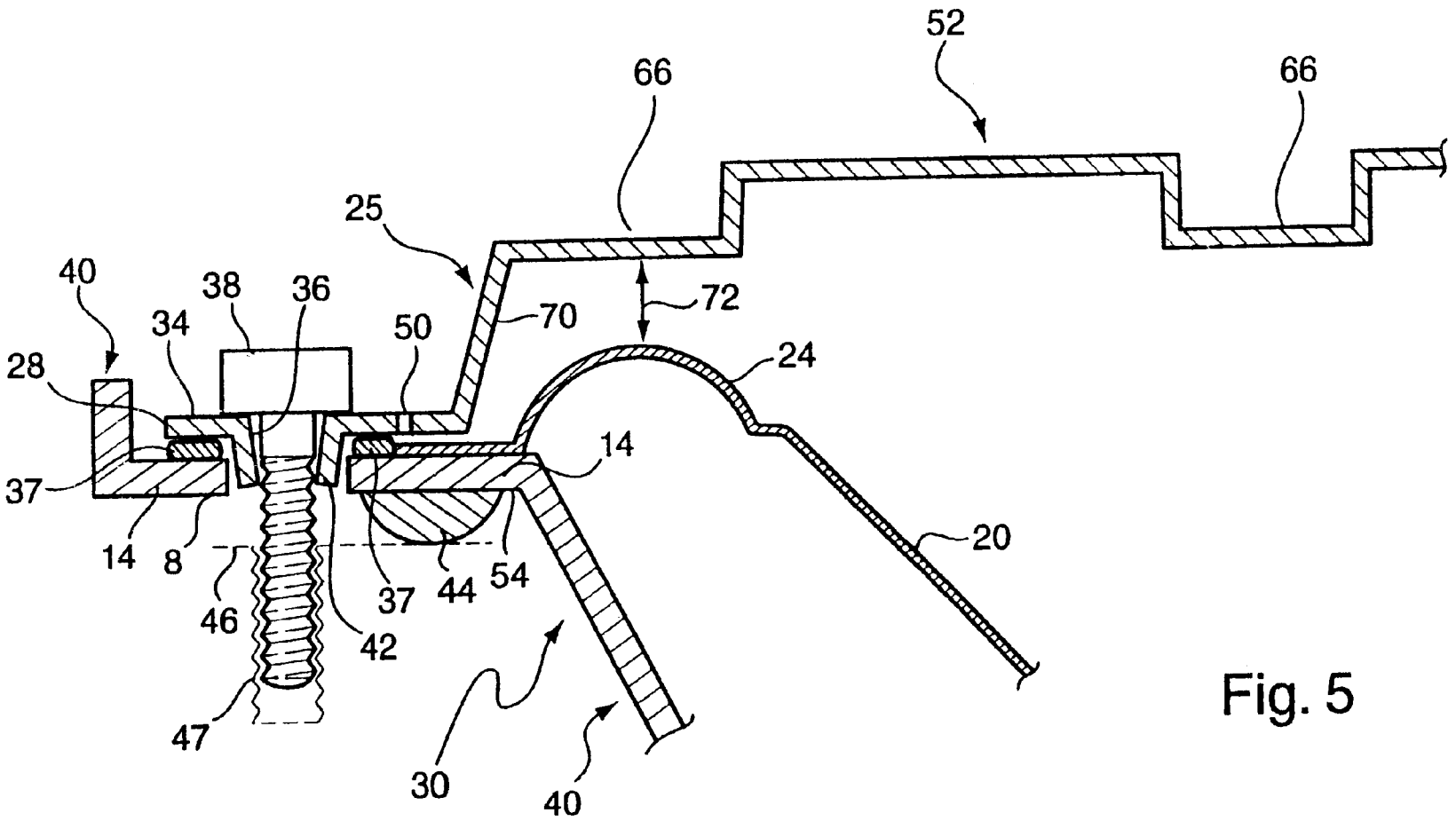
FIG. 5 is a cross-sectional view through the loudspeaker and loudspeaker protector, taken through line V—V of FIG. 2.

FIG. 5 shows a cross-sectional view through the loudspeakers protector 25 when affixed to the loudspeaker 30 by means of an adhesive 37 in the vicinity of the loudspeaker protector clearance holes 36. Also shown, is the metallic screw or bolt 38 passing through the hole 36 in the protector 25 and the matching clearance hole 8 in the loudspeaker metallic frame 40.

The loudspeaker protector 25 has a cylindrical sleeve 42 that extends through the frame clearance hole 8 so that the metallic screw 38 cannot contact the metallic frame 40. A compressible hemispheric button 44, for example made from a foam-like material or an elastomeric material, is also provided on an undersurface 54 of the flange 14 of the loudspeaker frame 40 to provide vibration isolation and electrical insulation between the frame 40 and a metallic support surface 46 to which the loudspeaker 30 is secured by the four screws or bolts 38.

Figure 6:
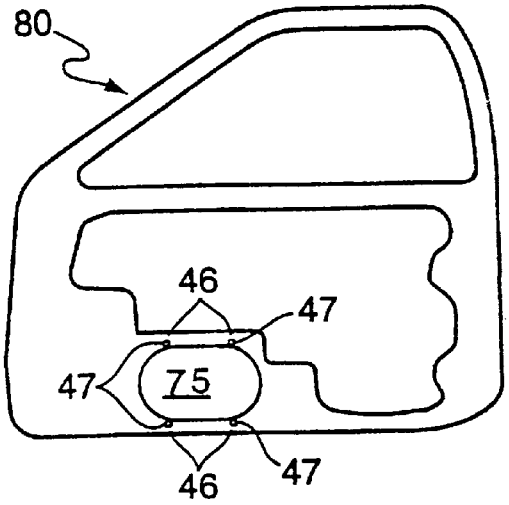
FIGS. 6, 7 and 8 are views of the internal surfaces of a car door, before, during and after installation of a loudspeaker with the loudspeaker protector of FIG. 2.
Figure 7:
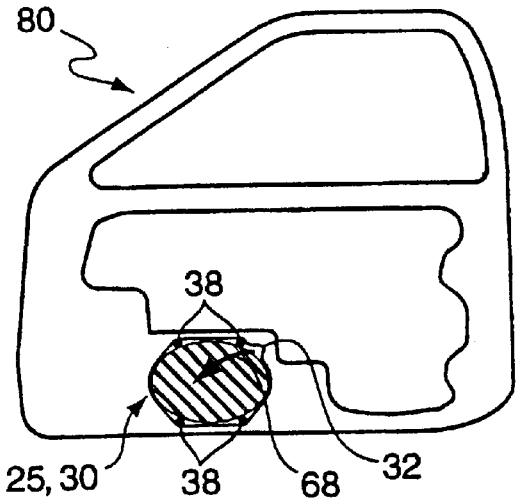
Figure 8:
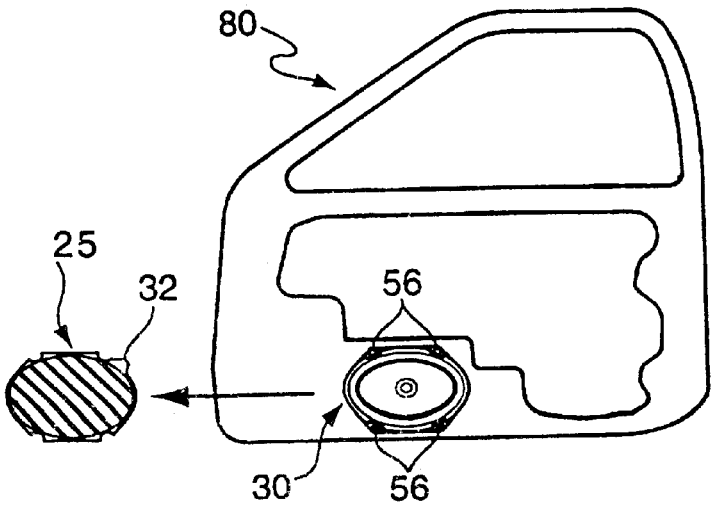

As indicated by FIGS. 5 and 6, the loudspeaker 30 with loudspeaker protector 25 is first assembled to the supporting surface 46 with the loudspeaker protector 25 still protecting the loudspeaker cone 20. The loudspeaker protector 25 has semicircular perforations 50 that extend around each of the mounting points 36 of the protector 25, terminating at a peripheral edge 28 of the protector. The perforations therefore separate a central portion 52 of the protector 25 from four small portions 56 of sheet material 26 that extend around each of the four clearance holes 36.

The perforations 50 form a line of weakness in the loudspeaker protector 25 so that a person may grip the projecting tab 32 and lift the protector 25 away from the loudspeaker 30 to cause the protector 25 to tear along each of the four perforations 50, and thereby remove the loudspeaker protector central portion 52 from the loudspeaker 30. The loudspeaker protector 25 is substantially removed from the loudspeaker 30, except for the four small portions 56 that remain adhered by the adhesive 37 and secured by the bolt 38 to the peripheral flanges 14 in the loudspeaker frame 40. The cylindrical insulating sleeves 42 therefore remain in place between the metallic screw 38 and loudspeaker frame 40.

As can be seen from FIG. 2, the pull-tab extends from a rim or peripheral region 34 of the sheet material forming the loudspeaker protector 52, but in such a way that this pull-tab 32 does not extend beyond rectangular bounds 60 defined by the long and short axes 62,64 of the oval loudspeaker cone 20. This arrangement facilitates packaging of the assembled loudspeaker 30 and protector 25, e.g. inside a matching rectangular cardboard shipping box (not shown). The pull-tab 32 therefore extends in a direction that lies between the major axis 62 and minor axis 64 of the oval loudspeaker 30.

The central area 52 of the loudspeaker protector 25 is provided with a series of parallel corrugations 66 which have a rectangular channel cross-section as shown in FIG. 5. The corrugations 66 extend in a direction transverse to a pull direction 68 of the pull-tab 32. The corrugations 66 therefore permit the central area 52 to curl and roll in the pull direction 68 as the pull-tab 32 is used to remove the central area 52 of the loudspeaker protector 25 from the loudspeaker 30. The corrugations 66 therefore provide stiffening in a direction normal to the plane of FIG. 2, while still permitting easy removal of the central area 52 of the protector 25 after the loudspeaker 30 has been installed in its enclosure 75.

In order to help ensure that the central area 52 is removed after installation of the loudspeaker 30, it is preferable if the loudspeaker central area 52 has a color noticeably different from that of the loudspeaker cone 20. Usually, loudspeaker cones 20 are black, and so at least a portion of the central area 52 should be colored with a color other than black. Similarly, because the areas 56 of the loudspeaker protector 25 are left in place after removal of the central area 52, it is preferable if these peripheral regions 56 of the loudspeaker protector 25 are colored black.

In order to provide the maximum protection, the central area 52 of the loudspeaker protector 25 is domed by a step 70 that rises from the peripheral rim 34 of the protector 25. This provides a clearance gap 72 between the rubber isolating ring 24 connecting the loudspeaker cone 20 to the loudspeaker frame 40.

The loudspeaker protector 25 according to the invention is relatively cheap to manufacture in large volumes. Because the protector 25 is temporary, it does not need to be designed to let sound from the loudspeaker pass through the protector with minimum disturbance. There is also no need to design the protector 25 so that this does not rattle or vibrate when the loudspeaker is operational. The material of the loudspeaker protector 25 may also be recyclable, thereby providing additional cost savings and reduced environmental impact. A loudspeaker protector according to the invention wherefore provides an economical solution to the problem of how to provide protection to the fragile parts of a loudspeaker between the manufacture of the loudspeaker and installation in an enclosure.

It is to be recognized that various alterations, modifications, and/or additions may be introduced into the constructions and arrangements of parts described above without departing from the spirit or scope of the present invention, as defined by the appended claims.

What is claimed is:

1. A loudspeaker protector, comprising: a sheet of flexible material, the sheet being bounded by an edge; one or more mounting points on the sheet, each mounting point being adapted to receive a fixing member through the sheet and being positioned in a peripheral region of the sheet; and one or more lines of weakness in the sheet, the sheet being thereby adapted to tear or break preferentially along the lines of weakness; in which the lines of weakness separate the peripheral region at each mounting point from a central area of the sheet, so that the central area of the sheet may be torn from the peripheral region(s) after the or each mounting point has been held down by said fixing member(s).

2. A loudspeaker protector as claimed in claim 1, in which the or each mounting point is a hole through the sheet, the sheet including a sleeve that extends transversely away from the sheet around said hole.

3. A loudspeaker protector as claimed in claim 1, in which the sheet includes a pull-tab that extends from a peripheral region of the sheet.

4. A loudspeaker protector as claimed in claim 1, which the sheet includes a pull-tab that extends from a peripheral region of the sheet, and the sheet is elongate with a major axis extending along the length of the sheet, and a minor axis extending transverse to the major axis along the width of the sheet, the pull-tab extending between the major axis and the minor axis.

5. A loudspeaker protector as claimed in claim 4, in which the major axis and minor axis define the orientation of a notional rectangle with length and width equal to that of the elongate sheet, the tab not extending beyond the bounds of the notional rectangle.

6. A loudspeaker protector as claimed in claim 1, in which at least a portion of the sheet is colored with a color other than black.

7. A loudspeaker protector as claimed in claim 1, in which the peripheral region(s) of the sheet beyond the lines of weakness are colored black.

8. A loudspeaker protector as claimed in claim 1, in which the sheet has a domed central area.

9. A loudspeaker protector as claimed in claim 1, in which the central area of the sheet includes corrugations.

10. A loudspeaker, comprising a frame, one or more mounting feature by which the loudspeaker may be secured to an external object, a loudspeaker cone, and a loudspeaker protector, in which the cone is supported peripherally by the frame, the mounting feature are provided on the frame beyond the periphery of the cone, the loudspeaker protector is affixed to the frame to protect the cone supported within the frame, and the loudspeaker protector has one or more mounting points in alignment with the mounting features of the frame, wherein the loudspeaker protector comprises: a sheet of flexible material, the sheet being bounded by an edge; one or more mounting points on the sheet, each mounting point being adapted to receive a fixing member through the sheet and being positioned in a peripheral region of the sheet; and one or more lines of weakness in the sheet, the sheet being thereby adapted to tear or break preferentially along the lines of weakness; in which the lines of weakness separate the peripheral region at each mounting point from a central area of the sheet, so that the central area of the sheet may be torn from the peripheral region(s) after the or each mounting point has been held down by said fixing member(s).

11. A loudspeaker as claimed in claim 10, in which the frame is a metallic frame, the mounting features of the frame being formed in the metal of the frame, and the mounting points of the loudspeaker protector serve to insulate electrically the frame from the fixing member(s).

12. A loudspeaker as claimed in claim 11, in which each of the mounting features is an aperture in the frame, and the loudspeaker protector has a sleeve that extends into the aperture to insulate electrically the frame from the fixing member(s).

13. A loudspeaker as claimed in claim 10, in which the loudspeaker protector is glued to the loudspeaker in the vicinity of the mounting points.

14. A loudspeaker as claimed in claim 10, in which the periphery of the loudspeaker protector is essentially the same as that of the loudspeaker frame.

* * * * *